United States Patent [19]

Magee et al.

[11] 4,416,969

[45] Nov. 22, 1983

[54] HYDRAZIDE COMPOSITIONS, METHODS EMPLOYING THEM AND PHOTOGRAPHIC MATERIALS CONTAINING THEM

[75] Inventors: Paul M. Magee, Harrow; Gareth B. Evans, Berkhamsted, both of England

[73] Assignee: Eastman Kodak Company, Rochester, N.Y.

[21] Appl. No.: 413,903

[22] Filed: Sep. 1, 1982

[30] Foreign Application Priority Data

Sep. 2, 1981 [GB] United Kingdom ..... 8126621

[51] Int. Cl.[3] ..... G03C 5/54; G03C 1/40; G03C 1/28; G03C 5/24

[52] U.S. Cl. ..... 430/217; 430/410; 430/559; 430/598

[58] Field of Search ..... 430/217, 410, 598, 212, 430/559

[56] References Cited

U.S. PATENT DOCUMENTS

| | | | |
|---|---|---|---|
| 2,419,975 | 5/1947 | Trivelli et al. | 95/6 |
| 3,615,615 | 10/1971 | Heseltine et al. | 96/109 |
| 3,719,494 | 3/1973 | Kurtz et al. | 96/107 |
| 3,734,738 | 5/1973 | Kurtz et al. | 96/107 R |
| 3,759,901 | 9/1973 | Lincoln et al. | 260/240 G |
| 4,030,925 | 6/1977 | Leone et al. | 430/217 |
| 4,031,127 | 6/1977 | Leone et al. | 430/598 |
| 4,080,207 | 3/1978 | Leone et al. | 96/73 |
| 4,115,122 | 9/1978 | Adachi et al. | 96/76 R |
| 4,139,389 | 2/1979 | von König et al. | 96/24 |
| 4,276,364 | 6/1981 | Leone | 430/217 |
| 4,278,748 | 7/1981 | Sidhu et al. | 430/217 |

OTHER PUBLICATIONS

*Research Disclosure,* vol. 151, Nov. 1976, Item 15162.
*Research Disclosure,* vol. 176, Dec. 1978, Item 17626.

*Primary Examiner*—Richard L. Schilling
*Attorney, Agent, or Firm*—Carl O. Thomas

[57] ABSTRACT

A nucleating agent composition is described comprising a triazole substituted phenylhydrazide and an thiourea substituted phenylhydrazide wherein the molar ratio of the triazole substituted phenylhydrazide to the thiourea substituted phenylhydrazide is between 1:20 and 20:1. The described composition is useful in photographic emulsions, processing compositions and elements and provides excellent nucleation at low concentrations under a variety of processing conditions.

11 Claims, No Drawings

HYDRAZIDE COMPOSITIONS, METHODS EMPLOYING THEM AND PHOTOGRAPHIC MATERIALS CONTAINING THEM

FIELD OF THE INVENTION

The present invention relates to photographic processing compositions, silver halide emulsions and elements which are of the type which include an incorporated chemical fogging agent. Emulsions of this type include negative-working high contrast emulsions (also referred to as lithographic or simply lith emulsions) as well as certain direct-positive (also referred to as reversal) silver halide emulsions.

DESCRIPTION RELATIVE TO THE PRIOR ART

Photographic elements which produce images having an optical density directly related to the radiation received upon exposure are said to be negative-working. A positive photographic image is formed from two negative-working elements by exposing the second negative-working element to the negative made by exposure of the first. The negative of the first negative is a positive. A direct-positive image, on the other hand, is understood in photography to be a positive image which is formed without first forming a negative image.

Extremely high contrast negative images are formed by developing exposed silver halide grains under fogging conditions. Usually the fogging conditions are created by incorporating a chemical fogging agent in the silver halide emulsion or processing composition. The chemical fogging agent is often referred to in this art as a nucleating agent. High contrast negative emulsions including hydrazine and hydrazide nucleating agents are described, for example, in U.S. Pat. No. 2,419,975.

A conventional approach to forming a direct-positive image is to use a photographic element having an internal latent image-forming silver halide emulsion. Exposure of this type of silver halide emulsion produces a latent image predominantly on the interior of the silver halide grain. Developing such an exposed silver halide image in a developer which contains a developing agent capable of developing the surface of the silver halide grains but incapable of developing the interior of the grains produces a direct-positive image, provided that the surfaces of the silver halide grains are subjected to fogging conditions during development. In this process, the internal latent image-forming silver halide grains which received imagewise exposure, and therefore have an internal latent image, develop at a comparatively slow rate under these conditions. The internal latent image-forming silver halide grains which have not been imagewise exposed develop comparatively rapidly under these conditions. As with high contrast negative images, the fogging conditions can be provided by an incorporated nucleating agent or a nucleating agent in the processing composition.

In one highly preferred form of color diffusion transfer photography, the direct-positive, internal latent image-forming silver halide emulsions just described are used in combination with negative-working, dye image-providing compounds. Negative-working, dye image-providing compounds are those which produce a negative transfer dye image when used in combination with conventional negative-working silver halide emulsions. When these compounds are used with direct-positive emulsions such as those described above, a positive transfer dye image is formed.

An extremely wide variety of nucleating agents are known. The nucleating agents are either adsorbed to the surface of the silver halide or unadsorbed. Among adsorbed nucleating agents are heterocyclic ammonium quaternary salts, as illustrated by Kurtz et al U.S. Pat. Nos. 3,734,738 and 3,719,494, which optionally are alkynyl-substituted, as disclosed by Adachi et al U.S. Pat. No. 4,115,122, or hydrazonoalkyl-substituted, as disclosed by Lincoln et al U.S. Pat. Nos. 3,615,615 and 3,759,901. Arylhydrazides containing adsorption promoting moieties are disclosed by Leone et al U.S. Pat. Nos. 4,030,925, 4,031,127 and 4,080,207, Sidhu et al U.S. Pat. No. 4,278,478 and Leone U.S. Pat. No. 4,276,361, issued June 30, 1981. Sulfocarbazides are disclosed as nucleating agents in von Konig et al U.S. Pat. No. 4,139,387. The use of nucleating agents in internal latent image-forming direct-positive emulsions is reviewed in *Research Disclosure,* Vol. 151, November 1976, Item 15162. *Research Disclosure* is a publication of Industrial Opportunities Ltd.; Homewell, Havant; Hampshire, P09 1EF, United Kingdom.

The use of nucleating agents in silver halide emulsions is not without problems. For example, many nucleating agents must be incorporated in the emulsion in higher than desired quantities in order to achieve the desired photographic result. Further, many nucleating agents which might otherwise be desirable require special processing conditions. Still further, the contrast of a silver halide emulsion containing a nucleating agent is a function of the particular nucleating agent and it would be desirable to be able to control contrast in order to provide curve shape control.

SUMMARY OF THE INVENTION

We have found that a combination of certain nucleating agents provided certain desirable and unexpected properties. Incorporating both a triazole substituted phenylhydrazide nucleating agent and a thiourea substituted phenylhydrazide nucleating agent in a silver halide photographic emulsion on element or processing composition leads to the following advantages:

(1) A synergistic effect is produced which permits the use of decreased quantities of hydrazide. That is, the nucleation effect of the combination is greater than one would expect from the nucleation effect of each nucleator separately.

(2) Image formation is stimulated in some environments where the which are triazole substituted or thiourea substituted singly hydrazides have little effect. Such environments include those which have restricted supplies of base and oxygen, e.g., layers of a multilayer element which are closest to an oxygen-impermeable support and layers in elements processed by soaking in an activator or developer solution followed by lamination (restricted base supply).

(3) Varying the ratio of the two hydrazides gives a measure of characteristic curve shape control.

(4) Improved keeping properties (shelf life) of the photographic material (indicated by incubation tests) are obtained.

Thus, in its broadest aspect the present invention provides a nucleating agent composition comprising a triazole substituted phenylhydrazide and a thiourea substituted phenylhydrazide nucleating agent wherein the ratio of the triazole substituted phenylhydrazide to the thiourea substituted phenylhydrazide is between about 1:20 and 20:1. The described composition is useful in photographic processing compositions, emulsions and elements.

In one preferred embodiment of the present invention there is provided a silver halide photographic emulsion comprising a binder, radiation-sensitive silver halide grains and a nucleating amount of the described nucleating agent composition.

In another embodiment, there is provided a radiation-sensitive photographic element comprising a support having thereon a layer comprising the described silver halide photographic emulsion.

In preferred embodiments, the photographic element is a diffusion transfer element wherein the silver halide is an internal latent image type having associated therewith a redox dye-releasing compound.

DESCRIPTION OF PREFERRED EMBODIMENTS

According to the present invention there is provided a nucleating agent composition containing a triazole substituted phenylhydrazide and thiourea substituted phenylhydrazide. Useful triazole substituted phenylhydrazides include those having the formula:

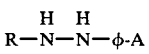

I.

wherein:

R is an acyl group;

$\phi$ is a phenylene or substituted phenylene group; and

A is a moiety comprising a triazole nucleus capable of promoting adsorption to a silver halide grain surface.

More specifically, preferred triazole substituted phenylhydrazide nucleating agents are those of the formula:

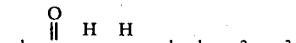

II.

wherein $R^1$ is hydrogen, an alkyl, cycloalkyl, haloalkyl, alkoxyalkyl or phenylalkyl substituent or a phenyl nucleus having a Hammett sigma-value-derived electron withdrawing characteristic more positive than −0.3;

$\phi^1$ is a m- or p-phenylene group or an alkyl-, halo-, benzoxy- or alkoxy-substituted m- or p-phenylene group;

$A^1$ is alkylene or oxyalkylene;

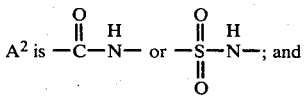

$A^3$ is a triazolyl or benzotriazolyl nucleus;

the alkyl and alkylene moieties in each instance including from 1 to 6 carbon atoms.

Still more specifically preferred triazole substituted phenylhydrazide nucleating agents are those of the formula:

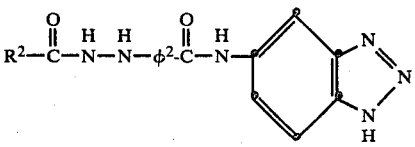

III.

wherein $R^2$ is hydrogen or methyl;

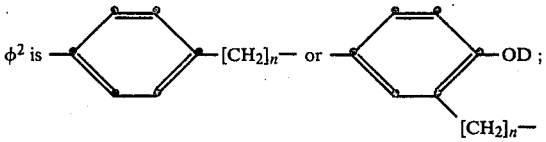

n is an integer of 1 to 4; and

D is alkyl of from 1 to 4 carbon atoms.

A more specific description of these nucleating agents is found in U.S. Pat. No. 4,278,748, col. 3, line 52 through col. 5, line 36. Methods of making and using these agents are also found in this reference. This disclosure is incorporated herein by reference.

Specific examples of preferred hydrazides of formula I are illustrated below in Table I.

TABLE I

A.

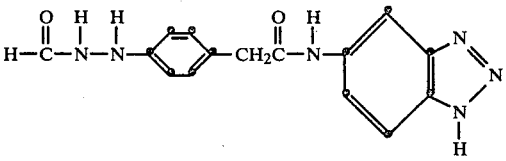

B.

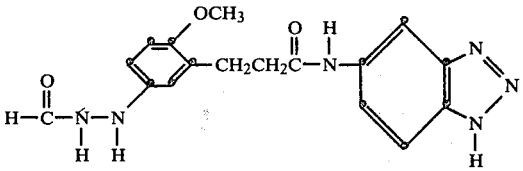

C.

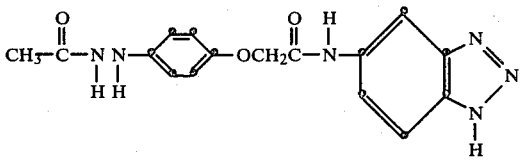

D.

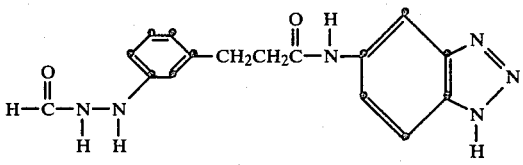

Useful thiourea substituted phenylhydrazides include those having the formula:

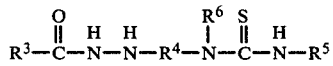

wherein:

$R^3$ is hydrogen; an alkyl, cycloalkyl, haloalkyl, alkoxyalkyl or phenylalkyl substituent or a phenyl nucleus having a Hammett sigma-value-derived electron withdrawing characteristic more positive than −0.3;

$R^4$ is a phenylene or alkyl, halo- or alkoxy substituted phenylene group;

$R^5$ is an alkyl, haloalkyl, alkoxyalkyl or phenylalkyl substituent having from 1 to 18 carbon atoms; a cycloalkyl substituent; a phenyl nucleus having a Hammett sigma-value-derived electron withdrawing characteristic less positive than +0.50; naphthyl or

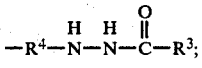

$R^b$ is hydrogen, benzyl, alkoxybenzyl, halobenzyl or alkylbenzyl;

the alkyl moieties, except as otherwise noted, in each instance include from 1 to 6 carbon atoms; and the cycloalkyl moieties have from 3 to 10 carbon atoms.

A more specific description of these nucleating agents is found in U.S. Pat. No. 4,030,925, col. 4, line 50 through col. 8, line 50. Methods of making and using these agents are also found in this reference. This disclosure is incorporated herein by reference.

Specific examples of preferred hydrazides of formula II are illustrated in Table II below.

TABLE II

1.

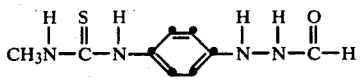

2.

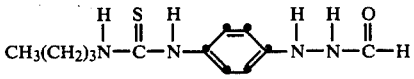

3.

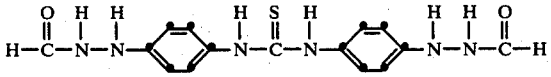

The molar ratio of triazole substituted phenylhydrazide to thiourea substituted phenylhydrazide is between 1:20 and 20:1. It will be understood that either component of the composition is a single compound or a mixture of compounds. It will also be understood that the composition is not limited to the described classes of nucleating agents but optionally contains other nucleating agents in minor amounts. In particularly preferred embodiments, the described molar ratio is between 1:4 and 2:1.

The present invention also provides a method for forming a direct-positive image which comprises imagewise exposing a layer of a photographic silver halide emulsion having internal latent image silver halide grains and developing the layer in the presence of a hydrazide composition according to the present invention.

The present hydrazide compositions are preferably employed in amounts of 0.001–500, especially 0.05–100 mg per mole of silver halide when incorporated in an emulsion.

The present hydrazide compositions are usefully in both black-and-white and color photographic materials. A preferred use is in photographic dye image transfer systems both of the peel-apart and integral type. Such materials are well known and are referred to, for example, in British Pat. No. 1,585,178 and in U.S. Pat. No. 4,030,925.

The described nucleating agent compositions are incorporated into internal latent image silver halide emulsions. Useful emulsions of this type are direct-positive emulsions (not prefogged) which form latent images predominantly inside the silver halide grains. These silver halide grains are distinguished from silver halide grains which form latent images predominantly on the surface of the grains. Useful internal latent image emulsions of this type are described in U.S. Pat. Nos. 2,592,250, 3,761,276, 3,761,266 and 3,761,267. Internal latent image silver halide emulsions are defined in terms of the increased maximum density obtained when developed to a negative silver image with a "internal-type" developer as compared with the image obtained when developed with a "surface-type" developer. An internal-type developer differs from a surface-type developer primarily in that the internal-type developer contains a silver halide solvent such as sodium sulfite.

The direct-positive silver halide emulsions containing the nucleating agent composition also comprise a binder or vehicle. The binder is usually a hydrophilic colloid which is used either alone or in combination with other vehicles. Suitable hydrophilic materials include both naturally occurring substances such as proteins, protein derivatives and cellulose derivatives. Useful binders include gelatin, alkali- or acid-treated gelatin, acylated gelatin, phthalated gelatin, polysaccharides such as dextran, and gum arabic. A further discussion of suitable vehicles is found in *Research Disclosure,* Volume 176, December, 1978, item 17643, paragraph IX.

A useful radiation-sensitive silver halide photographic element comprises a support having thereon a layer comprising the described internal latent image silver halide emulsion and, preferably in a separate layer, a redox dye-releasing compound. In preferred embodiments, these dye image-providing materials are ballasted nondiffusible redox dye releasers. These are compounds which are oxidized, i.e., crossoxidized, by an oxidizing developing agent to provide a species which, as a function of oxidation, will release a diffusible dye, such as by alkaline hydrolysis. Useful redox dye releasers are described in U.S. Pat. Nos. 3,725,062, 3,993,638, 3,698,897, 3,628,952, 3,443,939, 3,443,940, 4,076,529, 3,928,312, 3,728,113, 4,053,312 and 4,055,428; German Pat. Nos. 2,505,248 and 2,729,820; and *Research Disclosure* Vol. 151, Item 15157, November 1976, and *Research Disclosure* Vol. 156, Item 15654, April 1977.

The term "nondiffusible" means that the material will not substantially diffuse either within or from the layer in which it is located within the photographic element during contact with alkaline solution at a pH, for example, of greater than 11.

In one preferred embodiment, the radiation-sensitive silver halide photographic element is part of a photographic film unit. The photographic film unit comprises:

(a) an integral imaging receiver element comprising a support having thereon the described internal latent image photosensitive silver halide emulsion layer containing the nucleating agent composition and, associated therewith, a layer comprising the redox dye-releasing compound; a dye image-receiving layer; and, having adjacent the integral imaging receiver element, (b) a cover sheet comprising a timing layer, a neutralizing layer and a support; and (c) means for discharging an aqueous alkaline processing composition between the integral imaging receiver element and the cover sheet. The film unit is used to produce positive images in single- or multi-colors, as well as in black-and-white. In a three-color film unit, each silver halide emulsion layer of the film assembly will have associated therewith a dye image-providing material capable of providing a dye having a predominant spectral absorption within the region of the visible spectrum to which the silver halide emulsion is sensitive. For example, the blue-sensitive silver halide emulsion layer will have yellow dye image-providing material associated therewith.

Integral imaging receiver color diffusion transfer film units are disclosed in Canadian Pat. No. 928,559. In one particularly preferred embodiment, the support for the photosensitive element is transparent and is coated with the image-receiving layer, an opaque light-reflective layer, a black opaque layer and the photosensitive layers having associated therewith the dye image-providing materials. A rupturable container containing an alkaline processing composition and an opacifier such as carbon black is positioned adjacent to the top layer and a transparent cover sheet. The cover sheet comprises a transparent support which is coated with a neutralizing layer and the timing layer. The film unit is placed in a camera, exposed through the transparent cover sheet and then passed through a pair of pressure-applying members in the camera as it is being removed therefrom. The pressure-applying members rupture the container and spread the processing composition and opacifier over the image-forming portion of the film unit. The silver halide layers are developed by a developer in the processing composition and dye images are formed as a function of development. The dyes diffuse to the image-receiving layer to provide an image which is viewed through the transparent support on the opaque reflecting layer background. The timing layer breaks down after a period of time and makes available material to neutralize the alkaline processing composition so that further silver halide development does not take place. Further details concerning the format of this particular integral film unit are found in the above-mentioned Canadian Pat. No. 928,559. For details regarding the various components of the layers in this format, reference is made to *Research Disclosure,* Volume 151, November, 1976, item 15162. In an alternative format, the emulsions sensitive to each of the three primary regions of the spectrum are disposed as a single segmented layer, e.g., as by the use of microvessels as described in U.S. patent application No. 184,714 filed Sept. 8, 1980.

The silver halide emulsions useful in this invention are well-known to those skilled in the art and are described in *Research Disclosure,* Volume 176, December, 1978, Item 17643, pages 22–23, "Emulsion preparation and types"; they are usually chemically and spectrally sensitized as described on page 23, "Chemical sensitization" and "Spectral sensitization and desensitization", of the above article; they are optionally protected against the production of fog and stabilized against loss of sensitivity during keeping by employing the materials described on pages 24–25, "Antifoggants and stabilizers", of the above article; they usually contain hardeners and coating aids as described on page 26, "Hardeners", and pages 26–27, "Coating aids", of the above article; they and other layers in the photographic elements used in this invention usually contain plasticizers, vehicles and filter dyes described on page 27, "Plasticizers and lubricants"; page 26, "Vehicles and vehicle extenders"; and pages 25–26, "Absorbing and scattering materials", of the above article; they and other layers in the photographic elements used in this invention can contain addenda which are incorporated by using the procedures described on page 27, "Methods of addition", of the above article; and they are usually coated and dried by using the various techniques described on pages 27–28, "Coating and drying procedures", of the above article.

The term "associated with" means that the materials are in the same or different layers so long as the materials are accessible to each other during processing.

The following examples are included for a better understanding of the invention. Examples 1–3 employ nucleators with internal latent image emulsions to obtain a direct-positive image while Example 4 employs the nucleators to obtain a black-and-white high contrast negative image.

(Coating weights are parenthetically given in $g/m^2$ unless otherwise stated.)

EXAMPLE 1

Two multicolor coatings were prepared having the following structure:

| Multilayer 1 | |
|---|---|
| Layer 9 | Mordant X (0.05), gelatin (0.8) |
| Layer 8 | Blue Sens. Emulsion (Ag 0.30), ODSHQ (12 g/mole), Nucleator (1) (20 mg/mole), gelatin (1.0) |
| Layer 7 | Yellow RDR (0.6), gelatin (1.0) |
| Layer 6 | Didodecyl hydroquinone (0.4), Yellow Colloidal Silver (0.1), gelatin (0.8) |
| Layer 5 | Green Sens. Emulsion (Ag 0.30), ODSHQ (12 g/m), Nucleator (1) (38 mg/mole), gelatin (1.0) |
| Layer 4 | Magenta RDR (0.6), gelatin (1.0) |
| Layer 3 | Didodecyl hydroquinone (0.4), gelatin (1.0) |
| Layer 2 | Red Sens. Emulsion (Ag 0.30), ODSHQ 12 g/mole, Nucleator (1) (70 mg/mole), gelatin (1.0) |
| Layer 1 | Cyan RDR (0.6), gelatin (1.5) |
| //// /Poly(ethylene terephthalate) Support //// | |

Multicolor coating 2 is the same except that it contained 30 mg/mole silver halide nucleator (B) of Table I and 30 mg/mole of silver halide nucleator (1) of Table II in Layer 2. Thus, the molar ratio of triazole substituted phenylhydrazide (Nucleator B) to thiourea substituted phenylhydrazide (Nucleator 1) in layer 2 of Multilayer 2 was 0.63:1.

The coatings were hardened with 1,1'-bis(vinylsulfonyl)methyl ether at 1.5 percent of their dry gelatin weight. The compounds used in the above coating are as follows:

Layer 1
Cyan RDR:

-continued

Layer 1
Cyan RDR:

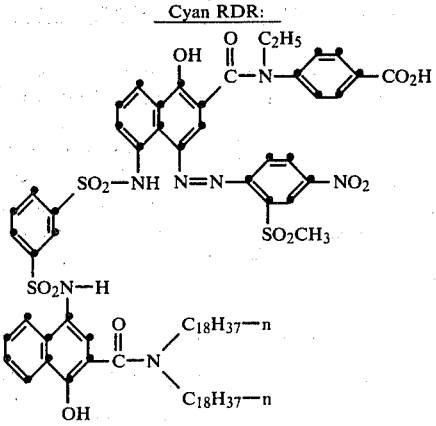

dispersed using diethyl lauramide which method is also used for the RDR in Layers 4 and 7.

Layer 2

ODSHQ=2-(2-Octadecyl-5-sulfohydroquinone) potassium salt. (ODSHQ is also in Layers 5 and 8.)

The emulsion contained 100 mg/mole of an antifoggant as did the emulsion in Layers 5 and 8.

Layer 4
Magenta RDR:

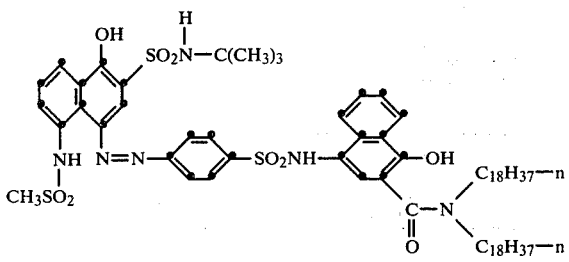

Layer 7
Yellow RDR:

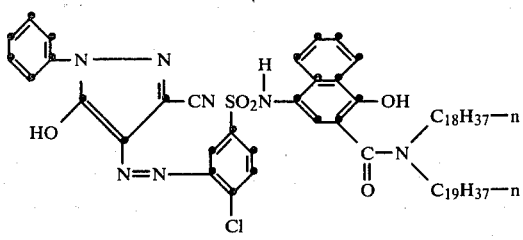

LAYER 9

Mordant X=poly(styrene-co-N-vinylbenzyl-N-benzyl-N,N-dimethylammonium sulfate-co-divinylbenzene) (ratio 99:99:2 by weight)

Layers 2, 5 and 8

Monodisperse 0.76μ core-shell silver bromide emulsions with a core to shell molar ratio of 1:2 were used in Layers 2, 5 and 8. These emulsions were chemically sensitized, internally with sulfur and gold in a 2:3 ratio by weight and on the surface with sulfur followed by spectral sensitization by either red, green or blue sensitizing dyes.

A receiver sheet of the following structure was also prepared (coating weights are in g/m$^2$).

| Receiver 1 |
|---|
| Mordant Y (2.2), 4-hydroxymethyl-4-methyl-1-phenyl-3-pyrazolidinone (0.16); Triethylamine (0.11); formaldehyde hardener |
| ////////// /Resin-coated Paper/ ////////// |

Mordant Y=Poly(vinylimidazole) 20 percent quarternized with benzyl chloride.

The multicolor coatings were exposed in a sensitometer using a step wedge to obtain neutral and color separation exposures. Each exposed coating was then soaked in the processing solution A for 15 seconds at 28° C. and then laminated to Receiver 1 by passing both the exposed strip and receiver sheet in register between a pair of rubber nip rollers.

| Processing Solution A | |
|---|---|
| Potassium hydroxide | 28 g/l |
| 5-methylbenzotriazole | 1.0 g/l |
| Benzyl alcohol | 8 ml/l |
| 11-aminoundecanoic acid | 2.0 g/l |
| Potassium bromide | 2.0 g/l |
| pH = 13.5 | |

The laminates were held at 22° C. and then peeled apart giving a total process time of 3 minutes. Comparison of the densities of the positive images obtained on the receiver demonstrated the enhanced nucleation of the red-sensitive layer by the mixed nucleator combination over that of type Nucleator (1) alone. Note particularly the large increase in red density for Multilayer 2 in comparison to Multilayer 1. The following red, green and blue densities of a given neutral step were recorded.

| | Density | | |
|---|---|---|---|
| | Red | Green | Blue |
| Multilayer 1 (Comparison) | 0.90 | 1.04 | 0.89 |
| Multilayer 2 | 2.03 | 0.88 | 0.97 |

EXAMPLE 2

Single color green-sensitive coatings of the following structure were made using the silver halide emulsion specified in Example 1:

| | |
|---|---|
| Layer 3 | Didodecylhydroquinone (0.4), gelatin (0.8) |
| Layer 2 | Green Sens. Emulsion (Ag 0.35), ODSHQ (12 g/mole), Nucleator (1) (various levels), Nucleator B (various levels), gelatin (1.0) |
| Layer 1 | Magenta RDR (0.43), gelatin (1.35) |
| //// /Poly(ethylene terephthalate) Support //// | |

The coatings were hardened with 1,1'-bis-(vinylsulfonyl)methyl ether at 1.5 percent of their dry gelatin weight.

Layer 1
Magenta RDR:

-continued

Layer 1

Magenta RDR:

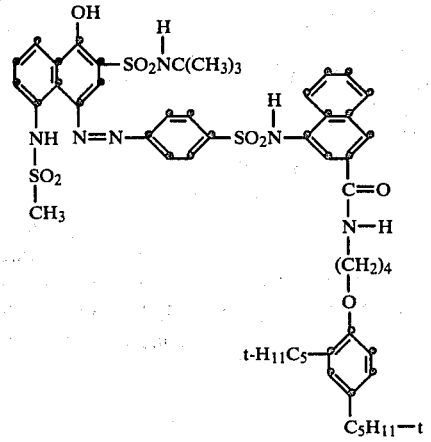

Receiver 2 of the following structure was prepared:

| Receiver 2 |
|---|
| Gelatin (0.86)<br>Mordant X (as defined above) (2.3);<br>4-hydroxymethyl-4-methyl-1-phenyl-3-methylpyrazolidinone (0.22); Gelatin (2.3); 1,1-bis(vinyl sulfonyl)methyl ether<br>/ / / / / / / / /Resin-coated Paper/ / / / / / / / / / |

The single color coating was exposed in a sensitometer using a step wedge to give a full scale image. The same processing solution and experimental procedure was used as for Example 1. The following green densities were obtained at a given step.

| Coating No. | Hydrazide of Formula I (mg/mole Ag Hal) | Hydrazide of Formula II (mg/mole Ag Hal) | Green Density (above stain) |
|---|---|---|---|
| 1 - Comparison | — | Nucleator 1 (15) | 0.63 |
| 2 - Comparison | — | Nucleator 1 (30) | 1.22 |
| 3 - Comparison | Nucleator B (37) | — — | 0.22 |
| 4 - Comparison | Nucleator B (75) | — — | 0.60 |
| 5 | Nucleator B (15) | Nucleator 1 (15) | 1.80 |

Higher density indicates more nucleation/development has occurred. The results show unexpected increases in density obtained by the combination of hydrazides compared to that obtained by each hydrazide when used separately, even at double the concentration.

EXAMPLE 3

Single color green-sensitive coatings having the following structure were made using the silver halide emulsion specified in Example 1:

| | |
|---|---|
| Layer 3 | Gelatin (1.0) |
| Layer 2 | Green Sens. Emulsion (Ag 0.43), Nucleator of Formula I (at level specified in Table), Nucleator of Formula II (at level specified in Table), gelatin (1.5) |
| Layer 1 | Magenta RDR (0.6), gelatin (1.5) |

-continued

| / / / / / /Poly(ethylene)-coated Paper Support/ / / / / |
|---|

The layers were hardened with 1,1'-bis-(vinylsulfonyl)methyl ether at 1.5 percent of their dry gelatin weight.

The coatings were exposed in a sensitometer using a step wedge to obtain a full scale image. After soaking in Processing Solution B for 15 seconds at 28° C. whey were laminated to Receiver 2 for 105 seconds. After peeling apart, the density of the receiver was read. The results are shown below.

| Coating No. | Hydrazide (mg/mole AgHal) Formula I | Formula II | Green Density |
|---|---|---|---|
| 1 - Comparison | B (10) | — | 0.32 |
| 2 - Comparison | B (20) | — | 0.37 |
| 3 - Comparison | — | 2 (12) | 0.55 |
| 4 - Comparison | — | 2 (24) | 0.57 |
| 5 | B (10) | 2 (12) | 1.58 |
| 6 - Comparison | D (9) | — | 0.30 |
| 7 - Comparison | D (18) | — | 0.48 |
| 8 - Comparison | — | 1 (10) | 0.68 |
| 9 - Comparison | — | 1 (20) | 1.35 |
| 10 | D (9) | 1 (10) | 1.82 |
| 11 - Comparison | C (11.5) | — | 0.25 |
| 12 - Comparison | C (23) | — | 0.60 |
| 13 - Comparison | — | 1 (10) | 0.67 |
| 14 - Comparison | — | 1 (20) | 1.35 |
| 15 | C (11.5) | 1 (10) | 1.51 |

Processing Solution B, pH=13.4, had the following composition:

| | |
|---|---|
| Sodium hydroxide | 33.6 g/l |
| 5-Methylbenzotriazole | 3.0 g/l |
| Potassium bromide | 2.0 g/l |
| 11-Aminoundecanoic acid | 2.0 g/l |

As in previous examples, the density obtained when a combination of hydrazides is used is unexpectedly greater compared to that obtained by each hydrazide separately, even when compared to double the concentration of the single hydrazide.

EXAMPLE 4

Negative High Contrast (Lith) Silver Image

An internal latent image silver chloride, green sensitized emulsion of 0.25 μm mean grain diameter was coated together with hydrazides as indicated below. These coatings had the structure:

| |
|---|
| Gelatin (1.1)<br>Green Sens. Emulsion (Ag 4.3), Nucleator B (various levels), Nucleator (3) (various levels), gelatin (4.3)<br>/ / / / /Poly(ethylene terephthalate) Support/ / / / / |

The layers were hardened with 1,1'-bis-(vinylsulfonyl)methy ether at 1.75 percent of their dry gelatin weight.

The coatings were exposed in a sensitometer to white light through a step wedge and then processed using the following developer adjusted to pH values 10–12 to obtain high contrast (lith) negative images.

| | |
|---|---|
| p-Methylaminophenol sulfate | 1.0 g/l |

-continued

| | |
|---|---|
| Sodium sulfite, anhydrous | 75 g/l |
| Hydroquinone | 9.0 g/l |
| Sodium carbonate, anhydrous | 25.5 g/l |
| Potassium bromide | 5.0 g/l |

The pH was adjusted as indicated with sodium hydroxide. A measure of the increased nucleation/development can be gained from the table below where at five pH levels between 10 and 12 a speed increase from the mixed nucleation coating over the other two coatings can be seen at all five pH values. Relative speeds were determined at density 0.20.

| Coating No. | Nucleators ($g/m^2$) | Relative Speed at various pH's 10.1 | 10.5 | 11.0 | 11.5 | 12.0 |
|---|---|---|---|---|---|---|
| 1 - Comparison | B (1.1) | 125 | 120 | 150 | 140 | 165 |
| 2 - Comparison | 3 (1.0) | 105 | 100 | 110 | 110 | 125 |
| 3 | B (0.55) + 3 (0.50) | 160 | 160 | 170 | 170 | 185 |

It can be seen that the coating of the invention using a combination of hydrazides produced higher speeds than a single hydrazide.

The invention has been described in detail with particular reference to preferred embodiments thereof, but it will be understood that variations and modifications can be effected within the spirit and scope of the invention.

What is claimed is:

1. A nucleating agent composition comprising a triazole substituted phenylhydrazide and a thiourea substituted phenylhydrazide wherein the molar ratio of said triazole substituted phenylhydrazide to said thiourea substituted phenylhydrazide is between 1:20 and 20:1.

2. A silver halide photographic emulsion comprising a binder, radiation-sensitive silver halide grains and a nucleating amount of a nucleating composition comprising a triazole substituted phenylhydrazide and a thiourea substituted phenylhydrazide wherein the molar ratio of said triazole substituted phenylhydrazide to said thiourea substituted phenylhydrazide is between 1:20 and 20:1.

3. A photographic element comprising a support having thereon a layer comprising a silver halide photographic emulsion comprising a binder, radiation-sensitive silver halide grains and a nucleating amount of a nucleating composition comprising a triazole substituted phenylhydrazide and a thiourea substituted phenylhydrazide wherein the molar ratio of said triazole substituted phenylhydrazide to said thiourea substituted phenylhydrazide is between 1:20 and 20:1.

4. A photographic diffusion transfer element comprising a support having thereon a layer comprising a redox dye-releasing compound having associated therewith an internal latent image silver halide emulsion comprising a binder, internal latent image silver halide grains and a nucleating amount of a nucleating agent composition comprising a triazole substituted phenylhydrazide and a thiourea substituted phenylhydrazide wherein the molar ratio of said triazole substituted phenylhydrazide to said thiourea substituted phenylhydrazide is between 1:20 and 20:1.

5. A photographic film unit comprising (a) an integral imaging receiver element comprising a support, an internal latent image silver halide emulsion comprising a binder, internal latent image silver halide grains and a nucleating agent composition comprising a triazole substituted phenylhydrazide and a thiourea substituted phenylhydrazide wherein the molar ratio of said triazole substituted phenylhydrazide to said thiourea substituted phenylhydrazide is between 1:20 and 20:1, a redox dye-releasing compound associated with said emulsion, and a dye image receiving layer;

(b) a cover sheet comprising a timing layer, a neutralizing layer and a support; and (c) means for discharging an aqueous alkaline processing composition between the integral imaging receiver element and the cover sheet.

6. The invention of claim 1, 2, 3, 4 or 5 wherein said triazole substituted phenyl hydrazide has the formula:

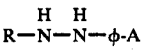

wherein:

R is an acyl group;

$\phi$ is a phenylene or substituted phenylene group; and

A is a moiety comprising a triazole nucleus capable of promoting adsorption to a silver halide grain surface.

7. The invention of claim 1, 2, 3, 4 or 5 wherein said thiourea substituted phenylhydrazide has the formula:

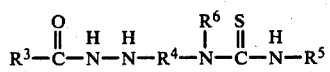

wherein:

$R^3$ is hydrogen; an alkyl, cycloalkyl, haloalkyl, alkoxyalkyl or phenylalkyl substituent or a phenyl nucleus having a Hammett sigma-value-derived electron withdrawing characteristic more positive than −0.3;

$R^4$ is a phenylene or alkyl, halo- or alkoxysubstituted phenylene group;

$R^5$ is an alkyl, haloalkyl, alkoxyalkyl or phenylalkyl substituent having from 1 to 18 carbon atoms; a cycloalkyl substituent; a phenyl nucleus having a Hammett sigma-value-derived electron withdrawing characteristic less positive than +0.50; napththyl or

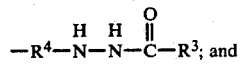

$R^6$ is hydrogen, benzyl, alkoxybenzyl, halobenzyl or alkylbenzyl.

8. The invention of claim 1, 2, 3, 4 or 5 wherein the ratio of said triazole substituted phenylhydrazide to said thiourea substituted phenylhydrazide is between 1:4 and 2:1.

9. The invention of claim 2, 3, 4 or 5 wherein said hydrazide composition is present in said emulsion in amounts between 0.05 and 100 mg per mole of silver halide.

10. The invention of claim 1, 2, 3, 4 or 5 wherein said triazole substituted phenylhydrazide has the formula:

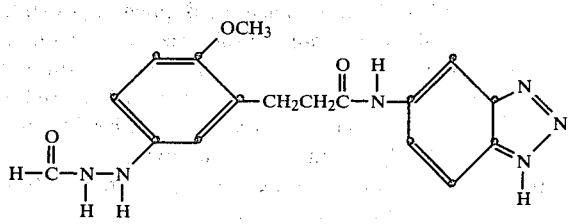

and said thiourea substituted phenylhydrazide has the formula:

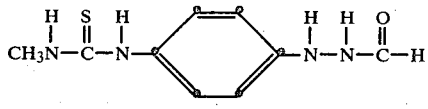

11. A method for forming a direct-positive image which comprises exposing a layer of a photographic silver halide emulsion having internal latent image silver halide grains and developing said layer in the presence of a triazole substituted phenylhydrazide and a thiourea substituted phenylhydrazide wherein the ratio of said triazole substituted phenylhydrazide to said thiourea substituted phenylhydrazide is between about 1:20 and 20:1.

* * * * *